United States Patent [19]

Castelli et al.

[11] Patent Number: 5,053,826

[45] Date of Patent: Oct. 1, 1991

[54] TRANSFER LOOP SYNCHRONIZATION IN RECIRCULATING COLOR PRINTERS

[75] Inventors: Vittorio R. Castelli, Yorktown Heights, N.Y.; Stephen T. Chai, Rancho Palos Verdes, Calif.

[73] Assignee: Xerox Corporation, Stamford, Conn.

[21] Appl. No.: 631,901

[22] Filed: Dec. 21, 1990

[51] Int. Cl.[5] ..... G03G 15/14

[52] U.S. Cl. ..... 355/271; 101/408; 271/204

[58] Field of Search ..... 271/204, 206; 355/271, 355/281, 308, 309, 326, 327; 101/408, DIG. 29

[56] References Cited

U.S. PATENT DOCUMENTS

| | | | |
|---|---|---|---|
| 3,275,318 | 10/1966 | Lavander | 271/204 |
| 3,924,849 | 12/1975 | Murakami | 271/204 X |
| 4,447,146 | 5/1984 | Kogane et al. | 271/204 X |
| 4,552,448 | 11/1985 | Davidson | 355/309 |
| 4,733,269 | 3/1988 | Kasahara et al. | 355/326 |
| 4,781,370 | 11/1988 | Weisgerber | 271/277 |
| 4,799,664 | 1/1989 | Burger | 271/277 |
| 4,849,795 | 7/1989 | Spehrley, Jr. et al. | 355/317 |
| 4,875,069 | 10/1989 | Takada et al. | 355/271 |
| 4,914,482 | 4/1990 | Ammenheuser et al. | 355/271 |
| 4,972,234 | 11/1990 | Tanaka et al. | 355/309 |
| 4,977,828 | 12/1990 | Douglas | 271/204 X |

*Primary Examiner*—A. T. Grimley

*Assistant Examiner*—Sandra L. Hoffman

*Attorney, Agent, or Firm*—Oliff & Berridge

[57] ABSTRACT

A method and apparatus for synchronizing a transfer loop in a recirculating color printer includes two spaced pairs of pulleys having a conveyor belt positioned thereabout for conveying sheets to a transfer zone for image transfer and an external pair of idler pulleys. A gripper bar on the conveyor belt advances the sheet. A photoconductive drum includes a portion in the transfer zone. A corona generating device is located in the transfer zone to charge the sheet so that it will attract an image from the photoconductive drum. A motion control servo provides ground-referenced control of motion of the conveyor belt as the gripper bar is delivered to the transfer zone. In the transfer zone, control is shifted to a phase detector which maintains constant the initially sensed phase between idler pulleys and a photoconductive drum coaxial therewith. When the gripper bar has exited the transfer zone, control of the conveyer belts reverts to a ground based system and the velocity is maintained the same as it was with the gripper bar in the transfer zone. After the trailing portion of the sheet exits the transfer zone, a length compensation cycle begins which adjusts gripper bar position in accordance with length differences between the conveyor belt and photoconductive drum.

8 Claims, 10 Drawing Sheets

TRANSFER LOOP SYNCHRONIZATION IN RECIRCULATING COLOR PRINTERS

BACKGROUND OF THE INVENTION

1. Field of the Invention

The present invention relates to a recirculating transfer loop for use in color printers and, more particularly, to a recirculating transfer loop for use in color printers which achieves proper registration of color separations by synchronizing motion in the transfer zone.

2. Description of the Related Art

In the electrophotographic type of printing machine, a photoconductive member is charged to a substantially uniform electrostatic potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms an image on the photoconductive member which is subsequently transferred to a copy sheet. The copy sheet is heated to permanently affix the developer material thereto in image configuration.

In multi-color electrophotographic printing, in addition to forming a single latent image on the photoconductive surface, successive latent images corresponding to different colors are additionally recorded thereon. Each single color electrostatic latent image is developed with toner particles of a color complementary thereto. The process is repeated a plurality of cycles for differently colored images and their respective complementarily colored toner particles. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

Toner images can be transferred to the copy sheet by an electrical field created by a corona generating device which induces transfer to the copy sheet by spraying a corona discharge having a polarity opposite to that of the toner particles on the photoconductive surface. This causes the toner particles to be electrically transferred to the copy sheet. In transferring multiple toner images, each toner image must be in superimposed registration with one another in order to produce a color copy which is not blurred.

The related art has disclosed printing systems which attempt to improve the accuracy of image transfer by assuring superimposed registration between a sheet and successive toner images.

U.S. Pat. No. 4,849,795 to Spehrley, Jr. et al discloses a sheet transport having a sheet gripper which moves in unison with spaced endless belts for advancing a sheet into registration with a developed image. A motor drive roll advances the belts. The motor is controlled by a servo and encoder which matches the gripper position with a position of a photoconductive belt. The gripper is moved at the same velocity as the photoconductive belt during the transfer of developed images. Between image transfers, the gripper is moved at a greater velocity than the photoconductive belt.

U.S. Pat. No. 4,914,482 to Ammenheuser et al discloses a sheet transport system for a color electrophotographic printing machine. A sheet gripper including a gripper bar mounted on a drum grips a sheet and guides it around the drum across a photoconductive drum. The gripper bar rotates relative to a stationary cylinder at substantially the same angular velocity as that of the drum. Registration pins stick out from the gripper bar and mate with holes in non-image areas of photoconductive drum to ensure that toner images are transferred to a copy sheet in superimposed registration with one another. A drive pulley is connected to a direct drive motor and controlled by a phase locked servo motor and an encoder to mate the registration pins with registration holes in the photoconductive drum.

U.S. Pat. No. 4,552,448 to Davidson discloses a sheet transport system for a multi-color printer which advances a sheet into registration with a developed image on a moving member. The sheet gripper bar is detachably coupled to a drum over a portion of the path of movement. A copy sheet is secured to the gripper bar. The gripper bar advances until it encounters a ramp which detaches the gripper bar from the drum. At this point the gripper bar is secured to the ramp and an arm rotates at an angular velocity close to that of the drum for 180° until it engages a slide. The gripper bar continues until it hits a stop. A motor coupled to an arm is energized in a timed sequence such that the tangential velocity of the gripper bar is equal to or slightly less than that of the drum. This may be done by a phase-locked servo and encoder. As the gripper bar approaches the drum, pins are precisely aligned and registered with holes in the drum. Once coupled, the bar advances with the drum through a transfer cycle so that a successive image can be transferred to a copy sheet in superimposed registration. The gripper bar is always in engagement with the photoconductive drum at exactly the same point.

U.S. Pat. No. 4,733,269 to Kasahara et al discloses a control system for a color copier in which a color document is repeatedly scanned by an optical system to sequentially expose a photoconductive drum to a plurality of separated color components. The system uses a paper size setting circuit to set the size of a transfer paper to be used before a copying operation and two servo circuits to determine transfer times in response to a paper size signal outputted by the paper size circuit. A scanning sensor senses the start of the scan and another sensor senses the instantaneous angular position of a transfer drum.

U.S. Pat. No. 4,781,370 to Weisgerber discloses a sheet gripper for a multi-color printer formed of an open portion which encloses a gripper spindle. A compression spring and an adjustment screw are located on the gripper to bias a gripper tip toward engagement with a gripper pad and permit adjustment of the disengaged gripper position with respect to the spindle and gripper pad.

U.S. Pat. No. 4,799,664 to Burger discloses a gripping mechanism which travels on a closed loop around a revolving path. The gripper mechanism has a hook-like gripper and a spring for urging the gripper to a clamped position.

The related art commonly registers the jaws of a gripper bar having a paper leading edge slot therein to appropriate pins on a photoreceptor drum to prevent relative slip during the period of close proximity. This is a poor solution because the initiation and termination of the contact creates disturbances in the motion of the drum, resulting in unwanted artifacts in the latent image being simultaneously written on the photoreceptor drum by the imaging device.

OBJECTS AND SUMMARY OF THE INVENTION

Accordingly, one object of the present invention is to provide an electrophotographic printing system which accurately superimposes registration of successive image transfers.

Another object of the present invention is to provide an electrophotographic printing system which provides accurate registration in the transfer area without creating disturbances in the motion of the photoconductive drum.

A further object of the present invention is to provide an electrophotographic printing system which accurately delivers a plurality of successive color separations.

To achieve the foregoing and other objects and advantages, and to overcome the shortcomings discussed above, an electrophotographic printing system is provided which achieves proper registration of successive color separations delivered by a photoconductive drum. A gripper bar is delivered in the vicinity of a transfer zone by a belt loop controlled by a motion control servo. The delivery is based on the feedback of an encoder mounted on pulleys for the belt loop. As the closest distance to the photoconductive drum is achieved, the control of the belt motion shifts its feedback to phase detection which measures changes in the relative angular position of a conveyor belt idler and the photoconductive drum. The control loop maintains constant the initially sensed phase. When the gripper bar leaves the photoconductive drum, this motion control continues. The system reverts to ground based feedback when the paper is out of the transfer zone and a length compensation cycle begins. The length compensation cycle adjusts the gripper bar position to compensate for the differences in the length of the belt loop and the circumference of the photoconductive drum.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
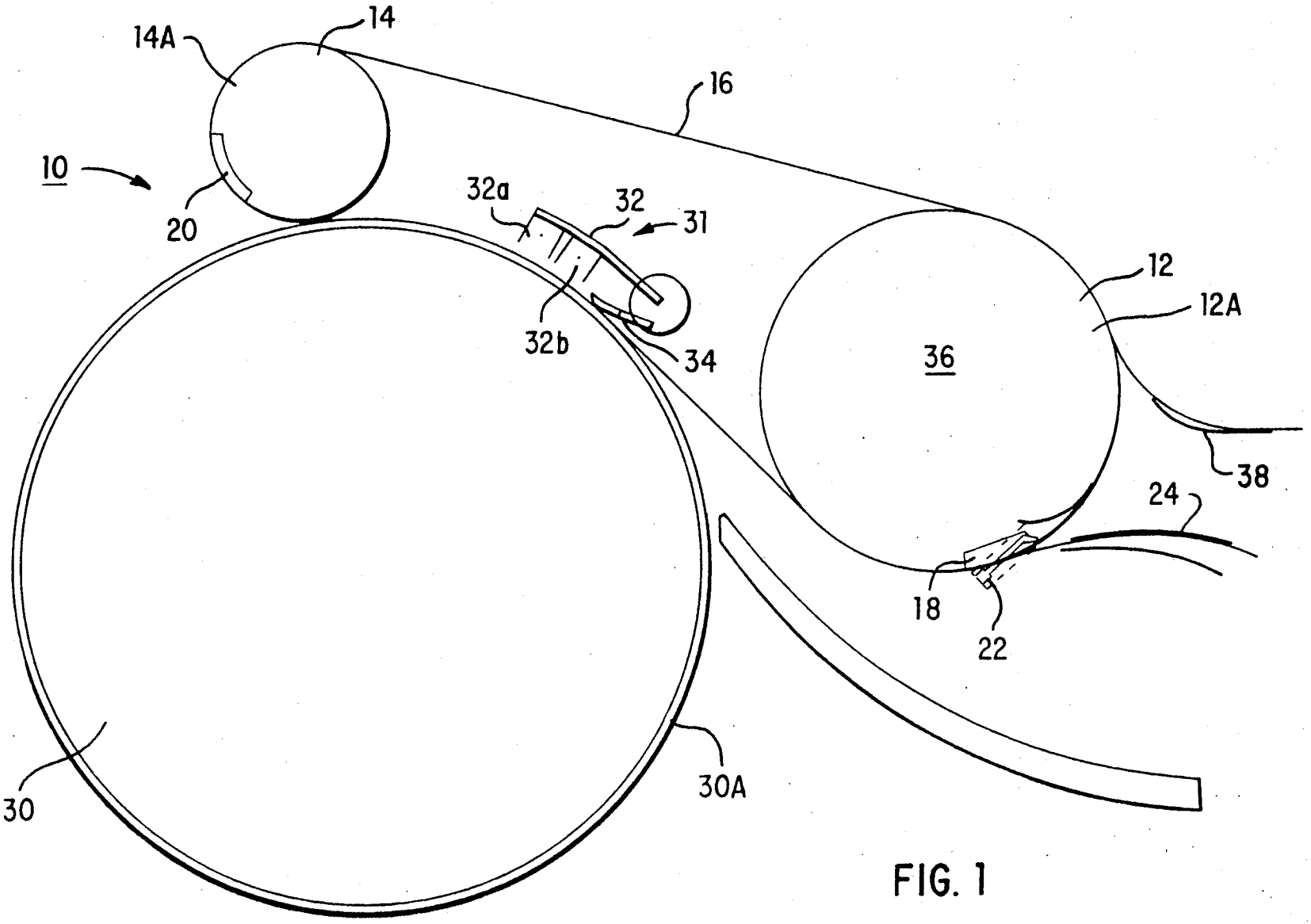
FIG. 1 is a schematic diagram of an electrophotographic printing system according to the present invention during infeed of a sheet.
Figure 10:
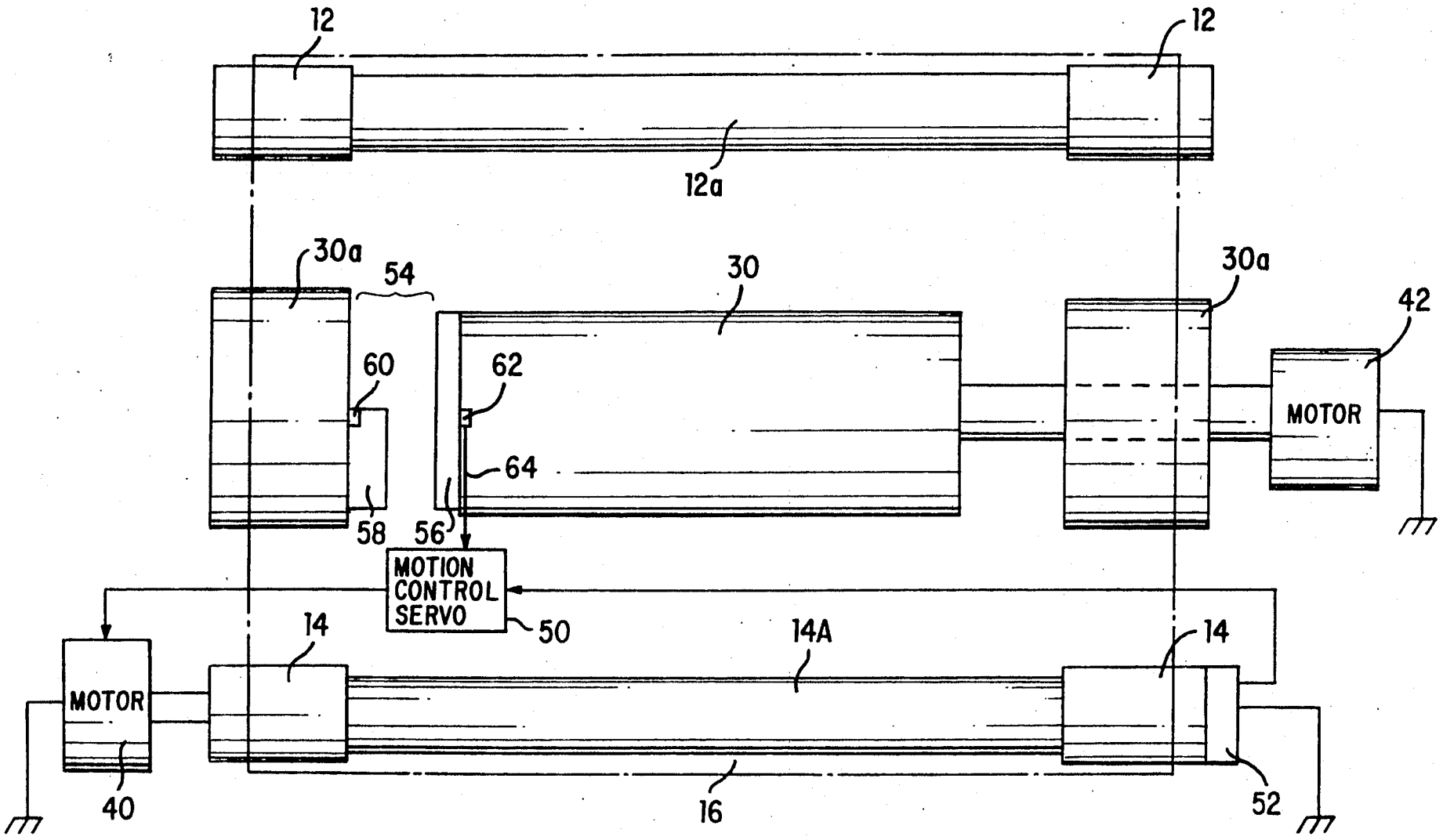
FIG. 10 is a top view of the electrophotographic printing system according to the present invention.

Referring now to the drawings, and particularly to FIG. 1 thereof, there is shown an electrophotographic printing system 10. Three pairs of conveyor belt pulleys 12, 14 and 30A are provided to control motion of conveyor belt 16. The pair of pulleys 30A are external to the conveyer belt loops and are coaxial with the photoreceptor drum and at either end of it. An infeed chute 24 leads to a paper infeed of pulley 12. As an infeed sheet reaches pulley 12, a gripper bar 22 positioned within a recess 18 opens to engage the sheet. Pulleys 12 or 14 have their motion controlled, for example, by a motor 40 (FIG. 10). The other of pulleys 12 or 14 not controlled by motor 40 operates as an idler which rests on or presses against belt 16 to guide it.

A photoconductive drum 30 is provided in system 10. The motion of drum 30 is controlled by a motor 42 (FIG. 10). At a charging station 31, a corona generating device 32, or corotron, sprays ions onto the backside of a sheet so as to charge the sheet to the proper magnitude and polarity for attracting a toner image from a photoconductive belt or photoconductive drum 30. Toner images are successively transferred to the sheet in superimposed registration with one another as the sheet is recirculated. System 10 can be used with a plurality of imaging devices such as a raster output scanner, ionographic head or light bar. The above process is repeated for each color forming the color image.

The corona generating device 32 includes a member 32B which places required charge on the photoconductive surface of drum 30. Member 32A acts as a leveling device which fills in any areas missed by member 32B or a detaching means which facilitates the separation of the copy sheet from drum 30 without damaging the images. Member 34 is pivoted and mechanically controlled to be raised from gripper bar 22 while it passes therebeneath. Member 34 then moves downwardly to engage the sheet after gripper bar 22 passes. Member 34 is once again lifted when the trailing edge of the sheet has advanced past the transfer zone.

Figure 2:
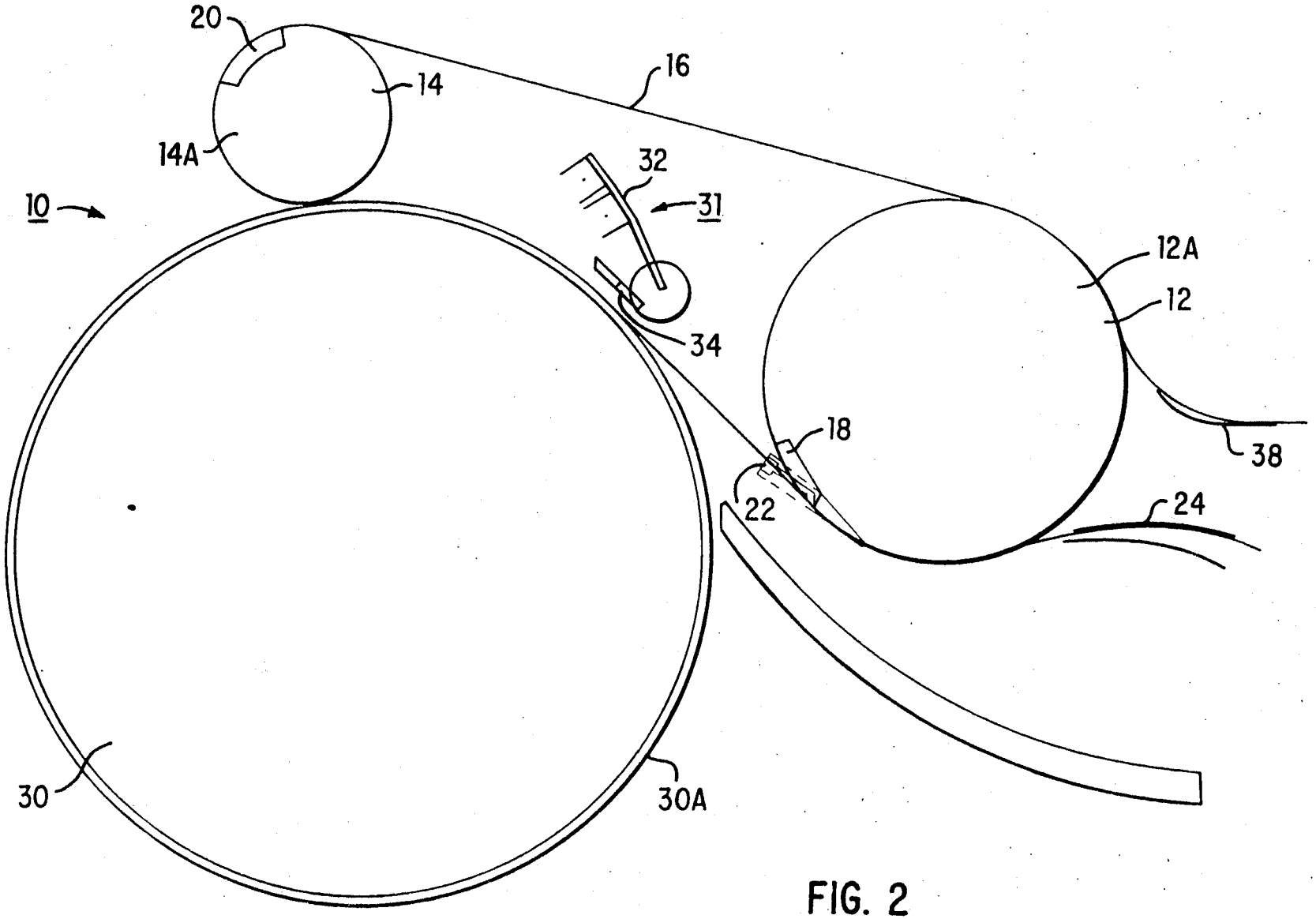
FIG. 2 is a schematic diagram of the electrophotographic printing system as the infeed sheet moves toward a transfer zone.

The infeed sheet and gripper bar 22, as illustrated in FIG. 2, move along conveyor belt 16 under control of a motion control servo 50 (shown in FIG. 10) based on the feedback of a ground based encoder 52 (also shown in FIG. 10). The encoder 52 is mounted on one of pulleys 12 and 14. Any suitable motor drive and encoder may be used. By way of example, a Pittman Model No. 9434 motor with a standard 5.9:1 gear head and a Hewlett Packard Model No. HEDS-5000 encoder may be used. The encoder 52 always keeps track of the total travel of belt 16.

Figure 3:
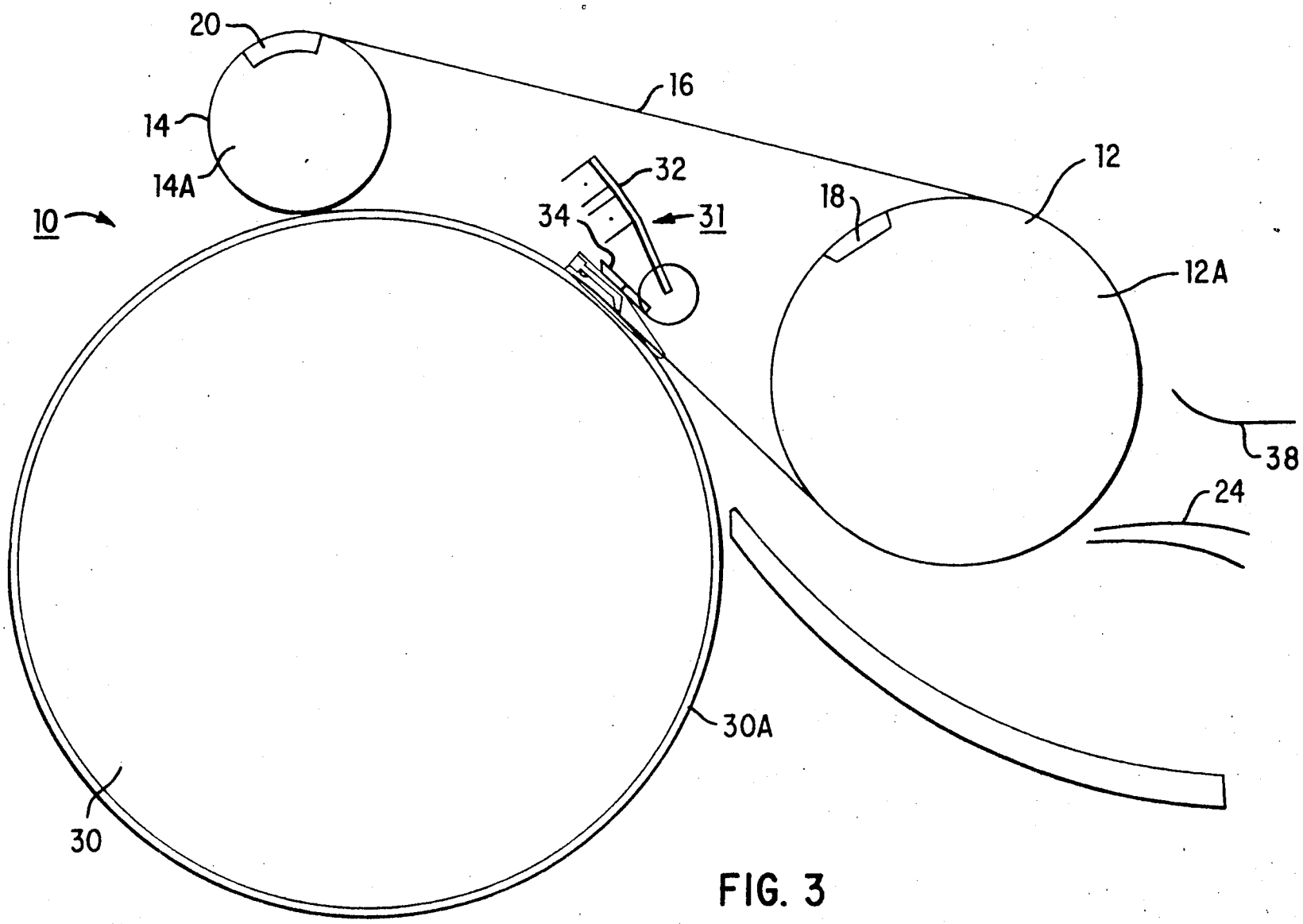
FIG. 3 is a schematic diagram of the electrophotographic printing system as the sheet enters the transfer zone.

As gripper bar 22 reaches the closest distance to photoconductive drum 30, as illustrated in FIG. 3, motion control servo 50 of conveyor belt 16 shifts its feedback to a phase detector 54 (shown in FIG. 10). The phase detector 54 measures changes in the relative angular position of conveyor belt idlers 30A and the photoconductive drum 30.

The phase detector 54 is similar to an angular encoder but is less costly. It is made of a 360° wheel 56 with alternating transparent and opaque sectors and of a segment of a wheel 58 containing a few sectors which are similar to the segments on the 360° wheel 56. One of the wheels is attached to the idler 30A while the other is attached to the photoconductive drum 30. A light source 60 mounted on the wheel segment 58 shines light through the two wheels 58 and 56 and a light intensity detector 62 measures the transmitted light. The resulting analog level is used as the phase signal 64. A servo control loop 50 is designed to maintain constant the initially sensed phase. The servo 50 controls the motion of belt 16 so that the amount of light passing through is constant in such a manner as to maintain said phase constant as the sheet moves through the transfer zone. The use of the phase detector 54 requires neither accuracy, concentricity nor great pattern angular frequency to function properly.

The detector signal 54 output as a function of phase has the shape of a saw tooth. Therefore, two patterns are present on the wheel segment 58 which are 90° out of phase from each other. In order to avoid being too close to the steps the output of the pattern which is closer to mid range is used as the active signal.

Gripper bar 22, therefore, travels without relative motion with respect to the photoconductive drum. As a result, superimposed registration of color separations is achieved without requiring pin registration which disturbs the photoconductive drum 30.

Figure 4:
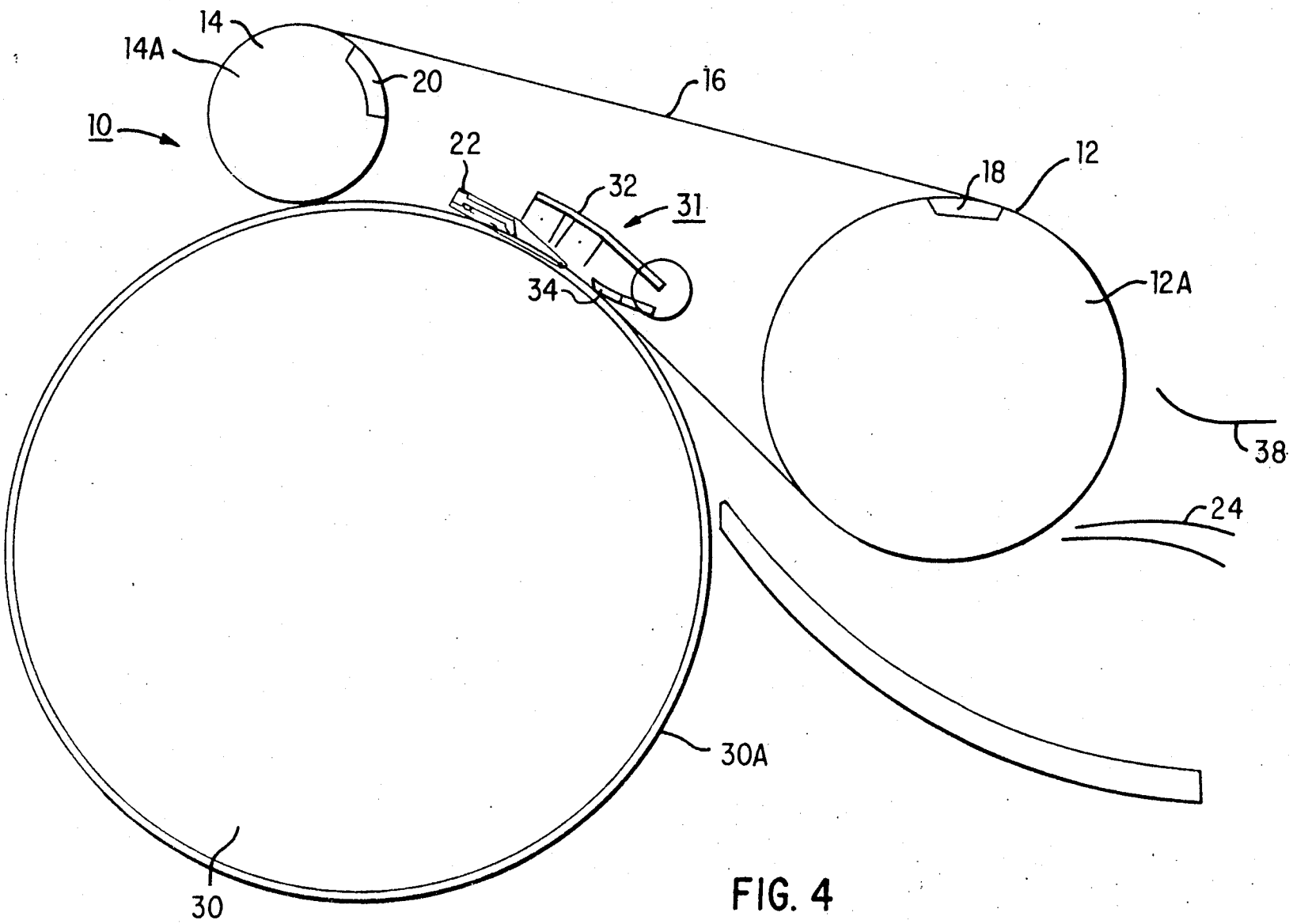
FIG. 4 is a schematic diagram of the electrophotographic printing system as the transfer begins.
Figure 5:
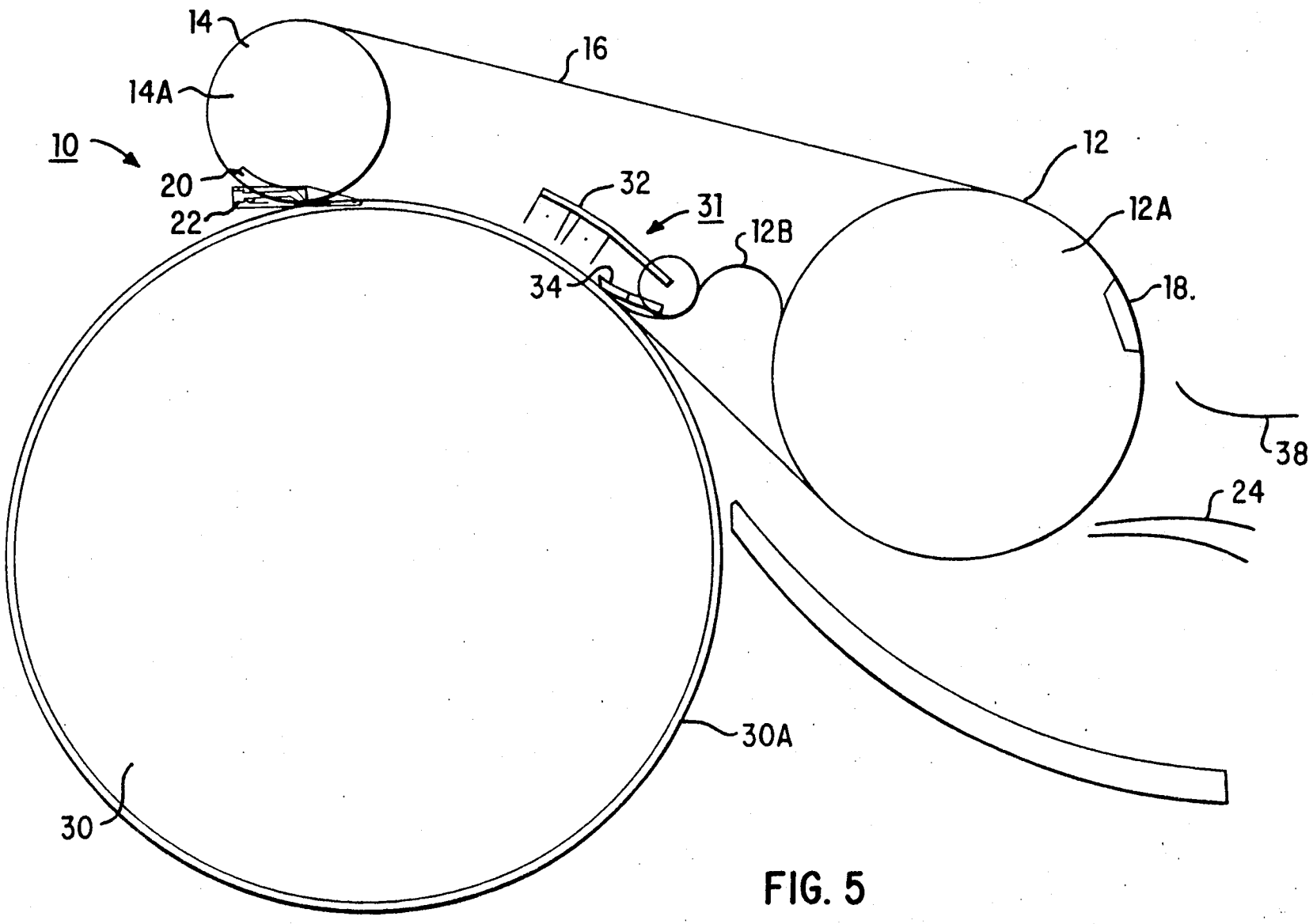
FIG. 5 is a schematic diagram of the electrophotographic printing system as the sheet leaves the transfer zone and enters a turn around roll.

As illustrated in FIG. 4, as gripper bar 22 leaves photoconductive drum 30, the phase detector mode of control continues. Only when the gripper bar 22 is out of the transfer zone and has started the turn on pulley 14, as illustrated in FIG. 5, does the system revert to ground based feedback. Gripper bar 22 engages groove 20 in a support drum 14A coaxial with and between pulleys 14 for turning around towards its approach to the pulley 12.

Because conveyor belt 16 and photoconductive drum 30 have circumferences which differ, a length compensation cycle begins when the sheet moves out of the transfer zone. FIG. 5 illustrates the beginning of the length compensation cycle. Between pulleys 12 is a vacuum drum 12A which is baffled from about 12 to 9 o'clock to provide a vacuum hold down of the copy sheet. Drum 12A is controlled in rotation independently from pulleys 12 by a motor (not shown).

Figure 6:
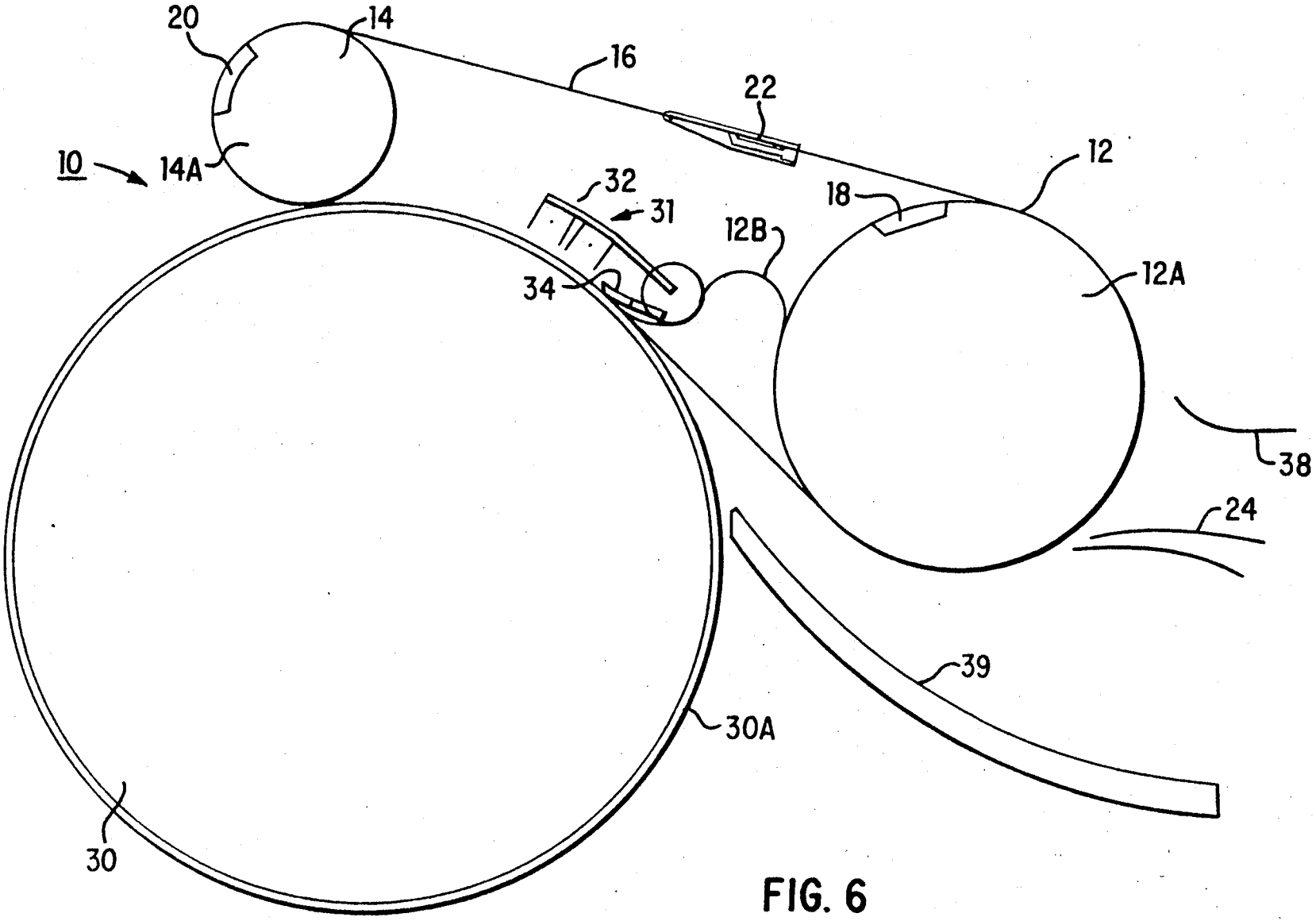
FIG. 6 is a schematic diagram of the electrophotographic printing system as the infeed pulley awaits the approach of the gripper bar.
Figure 7:
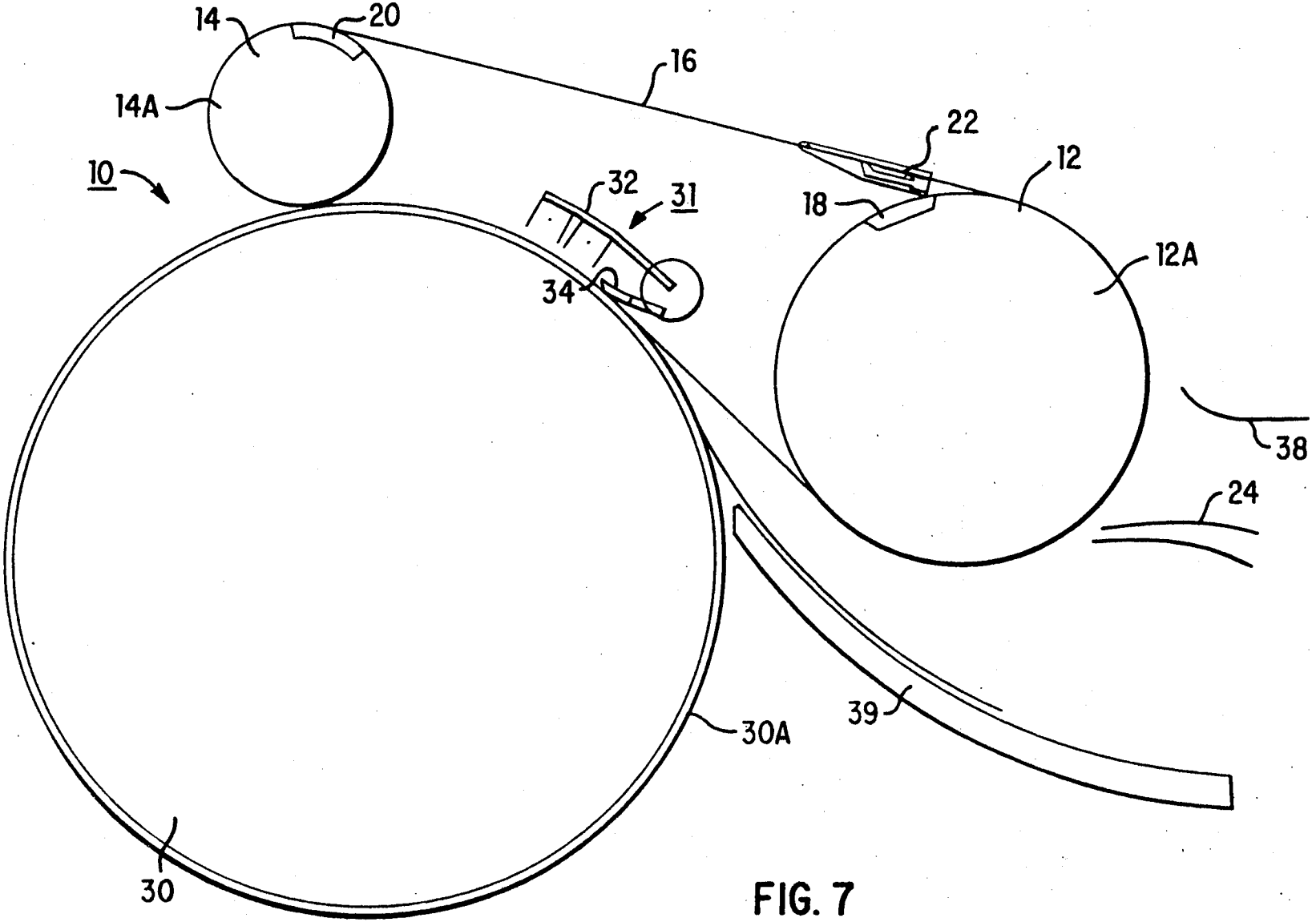
FIG. 7 is a schematic diagram of the electrophotographic printing system as the gripper bar meets the infeed pulley.

As illustrated in FIG. 6, when gripper bar 22 makes its turn to approach pulley 12, drum 12A stops rotating and waits for gripper bar 20 to approach groove 18. The vacuum hold down is removed such that the trailing portion of the sheet drops and the loop 12B in the sheet disappears. The sheet is then supported by positive pressure chute 39 (see FIG. 7).

Figure 8:
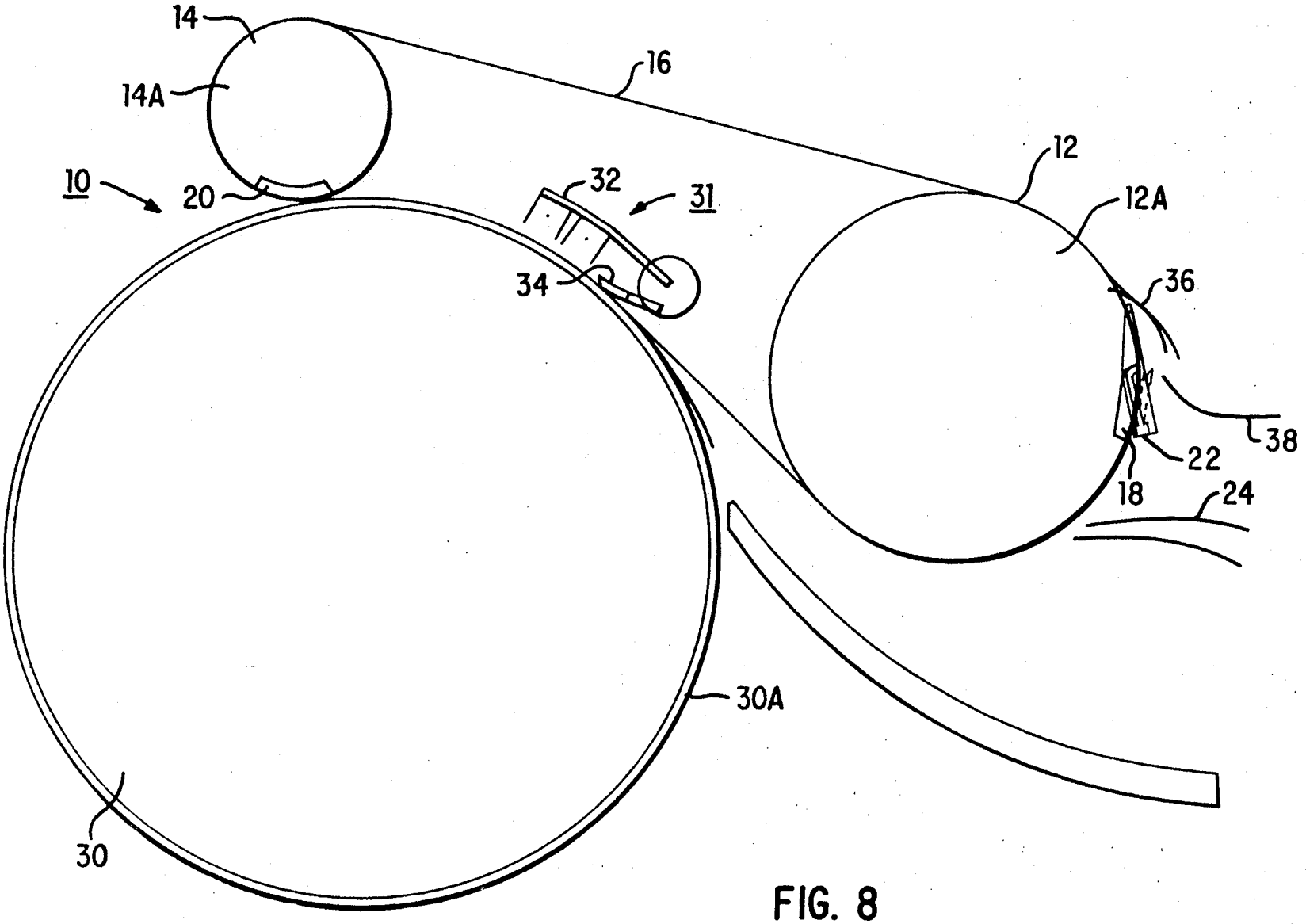
FIG. 8 is a schematic diagram of the electrophotographic printing system as the point of outfeed is reached.

As the gripper bar moves over pulley 12 and the sheet moves over drum 12A, a mechanism actuates opening of gripper bar 22. Kicker mechanism 36 (FIG. 8) is raised to lead the sheet to outfeed chute 38. Gripper bar 22 is then ready for receipt of a new sheet. If the sheet is recirculated through the same loop, kicker mechanism 36 remains lowered and the process is repeated.

As the gripper bar leaves pulleys 12 and approaches the transfer zone, drum 12A is rotatably advanced a predetermined angle so that loop 12B forms. This action has the purpose of avoiding force interaction through the copy sheet of drum 30 and 12A (FIGS. 5 and 6).

Figure 9:
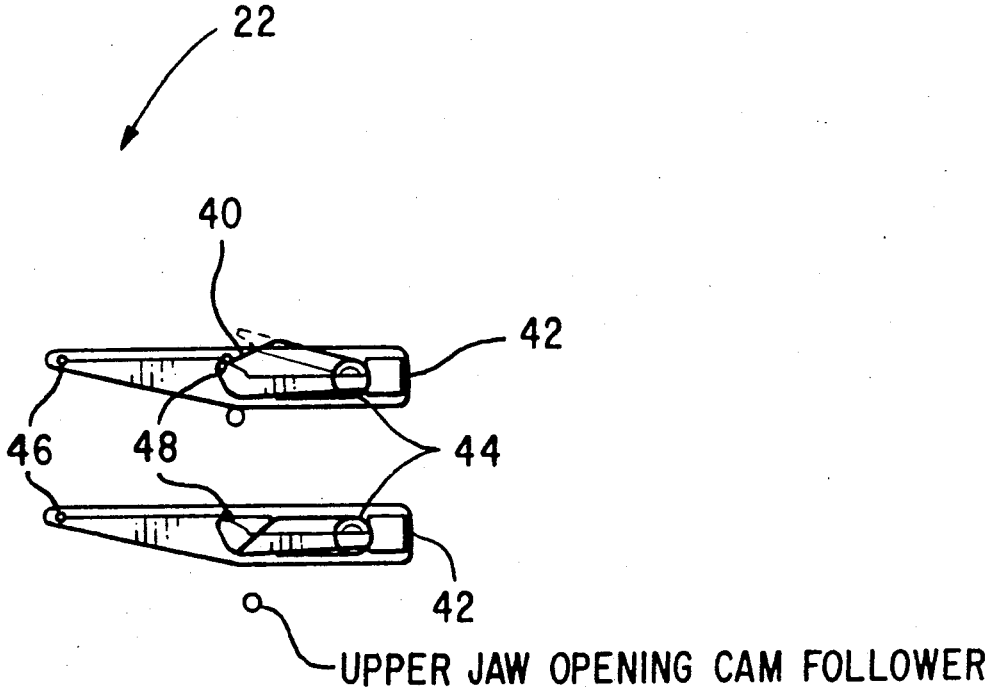
FIG. 9 is a side view of the gripper bar used in the electrophotographic printing system of FIGS. 1–8.

FIG. 9 provides a detailed description of gripper bar 22. The gripper bar includes a spring extension 40 which forms a throat for capturing a sheet to which images are transferred. Springs 44 provide the force of capturing the sheet. Gripper bar 22 further includes a side plate 42, a push point 46 which is rigidly connected to belt 16 and a follower point 48 which rides in a slot in belt 16 parallel to a pitch line.

In an electrophotographic printing system, points registered in each color separation must fall within a circle 1/200 of an inch in diameter to provide acceptable overlap of the plurality of separations. With the requirement for this degree of accuracy, there has been a great demand for devices which provide extremely accurate superimposition of color separations. The device according to the present invention brings the sheet repeatedly into the transfer zone in a manner achieving proper registration of the color separations delivered by the photoconductive drum. The device further provides synchronization of independent drive motions without providing vibration or other motion which would disturb the motion of the photoconductive drum.

While this invention has been described in conjunction with specific embodiments thereof, it is evident that many alternatives, modifications and variations will be apparent to those skilled in the art. For example, the control pulley and the idler pulley could be switched without affecting the operation of the device. Accordingly, the preferred embodiments of the invention as set forth herein are intended to be illustrative, not limiting. Various changes may be made without departing from the spirit and scope of the invention as defined in the following claims.

What is claimed is:

1. A recirculating transfer loop for a color printer comprising:

two pairs of spaced pulleys having a conveyor belt located thereabout;

a pair of idler pulleys;

a gripper bar connected to the conveyor belt for receipt and advancement of a sheet to which an image is to be transferred;

a photoconductive drum, said idler pulleys being coaxial with said photoconductive drum;

a transfer zone including a corona generating device which charges the sheet to a proper electrostatic potential and polarity for attraction of an image from the photoconductive drum, the transfer station being adjacent the area where the idler pulleys coaxial with the photoconductive drum contact the conveyor belt;

a first motion control means mounted to one of said spaced pulleys for controlled delivery of said gripper bar to said transfer zone; and a second motion control means for separately controlling relative motion of said conveyor belt when said gripper bar is in the transfer zone

2. The recirculating transfer loop as recited in claim 1, wherein:

said first motion control means is a ground-referenced encoder.

3. The recirculating transfer loop as recited in claim 1, wherein:

said second motion control means is a phase detector, the phase detector maintaining constant an initially sensed phase between the angular position of the idler pulleys and the photoconductive drum.

4. The recirculating transfer loop as recited in claim 1, further comprising:

means for adjusting gripper bar position when the gripper bar has passed through the transfer zone, said adjusting means compensating for differences in the length of the conveyor belt and the circumference of the photoconductive drum.

5. A method for controlling a recirculating transfer loop of a color printer comprising two spaced pairs of pulleys for conveying a conveyor belt thereabout, a pair of idler pulleys, a gripper bar positioned on the conveyor belt for receiving and advancing a sheet to which an image is to be transferred from a photoconductive drum by charging the sheet to a proper electrostatic potential and polarity for attraction of an image from the photoconductive drum, and a transfer zone located adjacent a region of contact between the external idler pulleys and the conveyor belt, the method comprising the steps of:

controlling the delivery of the gripper bar to the transfer zone using a first motion control located at one of the spaced pulley pairs; and separately controlling the relative motion of the conveyor belt when the gripper bar is in the transfer zone using a second different motion control.

6. The method as recited in claim 5, comprising the step of using a ground-referenced encoder as said first motion control.

7. The method as recited in claim 5, comprising the steps of:

using a phase detector as said second motion control and maintaining constant an initially sensed phase between angular position of the external idler pulleys and the photoconductive drum.

8. The method as recited in claim 5, comprising the steps of:

adjusting the gripper bar position when the gripper bar has passed through the transfer zone; and compensating for differences in the length of the conveyor belt and the circumference of the photoconductive drum.

* * * * *